United States Patent [19]

Aimar

[11] 4,125,312

[45] Nov. 14, 1978

[54] CONNECTOR FOR ELECTRICAL APPARATUS

[75] Inventor: Michele Aimar, Turin, Italy

[73] Assignee: ITW Fastex Italia, S.p.A., Turin, Italy

[21] Appl. No.: 810,324

[22] Filed: Jun. 27, 1977

[30] Foreign Application Priority Data

Jul. 5, 1976 [IT] Italy ..... 25013 A/76

[51] Int. Cl.[2] ..... H01R 13/58

[52] U.S. Cl. ..... 339/107; 339/109; 339/208

[58] Field of Search ..... 339/109, 103 M, 107, 339/208

[56] References Cited

U.S. PATENT DOCUMENTS

| | | | |
|---|---|---|---|
| 3,056,942 | 10/1962 | Carbaugh et al. | 339/103 M X |
| 3,856,376 | 12/1974 | Poliak et al. | 339/107 |
| 3,904,265 | 9/1975 | Hollyday et al. | 339/103 M |
| 4,029,896 | 6/1977 | Skinner | 339/208 X |

*Primary Examiner*—Roy Lake
*Assistant Examiner*—DeWalden W. Jones
*Attorney, Agent, or Firm*—Jack R. Halvorsen; Robert W. Beart

[57] ABSTRACT

A connector is provided of the type having the insulating body formed of a pair of similar half-shells adapted to be coupled to each other. The connector comprises a portion integrally formed therewith and forming a clamping region for the cable supplying the connector contacts.

8 Claims, 7 Drawing Figures

CONNECTOR FOR ELECTRICAL APPARATUS

This invention relates to connectors for electrical apparatus.

A problem which arises in the construction of a connector for electrical apparatus is to insulate the metal portion of the connector during the connection and disconnection operations thereof.

Another problem, particularly felt in applications such as domestic electrical appliances, electronic computers and electrical typewriters, is to make the cable including the conductor wires connected to the connector contacts independent of these contacts in the case of tension stresses to which the cable may be subjected, particularly during the disconnecting operation of the cable from the socket in which it is inserted. In order to obtain this, it is necessary to provide a cable clamping region, mechanically connected to the connector body so that any stress exerted on the cable is transmitted to the connector body and not to conductors of which the cable is formed and to the connector contacts connected to these conductors.

This invention aims to overcome these problems in a simple and inexpensive manner.

More particularly the connector according to the invention is of the type having the insulating body formed of a pair of similar half-shells adapted to be coupled to each other and is characterized in that each half-shell comprises a portion integrally formed with said connector and forming a clamping region for the cable supplying the connector contacts.

In this manner by means of a single piece obtained in a molding operation (the used material will be preferably a plastic material) the solution of the above problems is achieved in a simple and inexpensive manner.

The invention will be better understood from the following detailed description, given merely by way of example and therefore not intended in a limiting sense, of an embodiment thereof in connection with the accompanying drawings, wherein.

Figure 2:
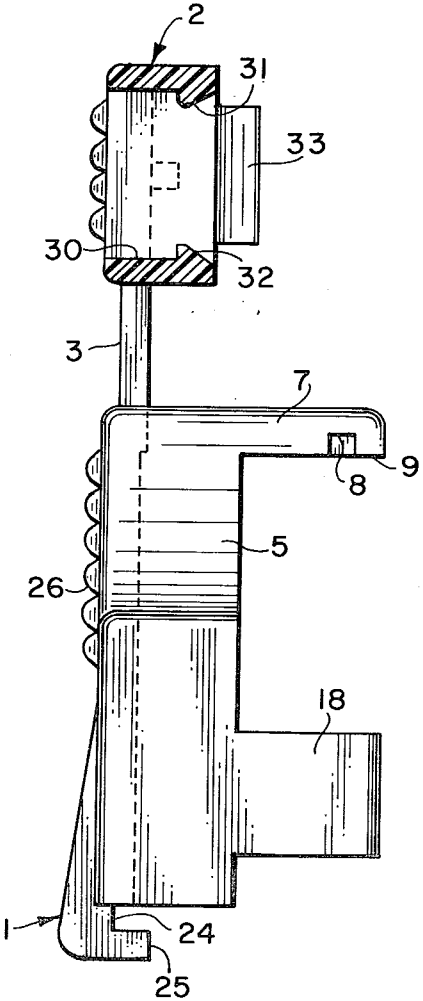
FIG. 2 is a sectional view taken along the line 2—2 of FIG. 1.
Figure 4:
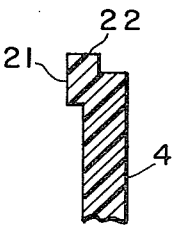
FIG. 4 is a sectional view taken along the line 4—4 of FIG. 1.
Figure 1:
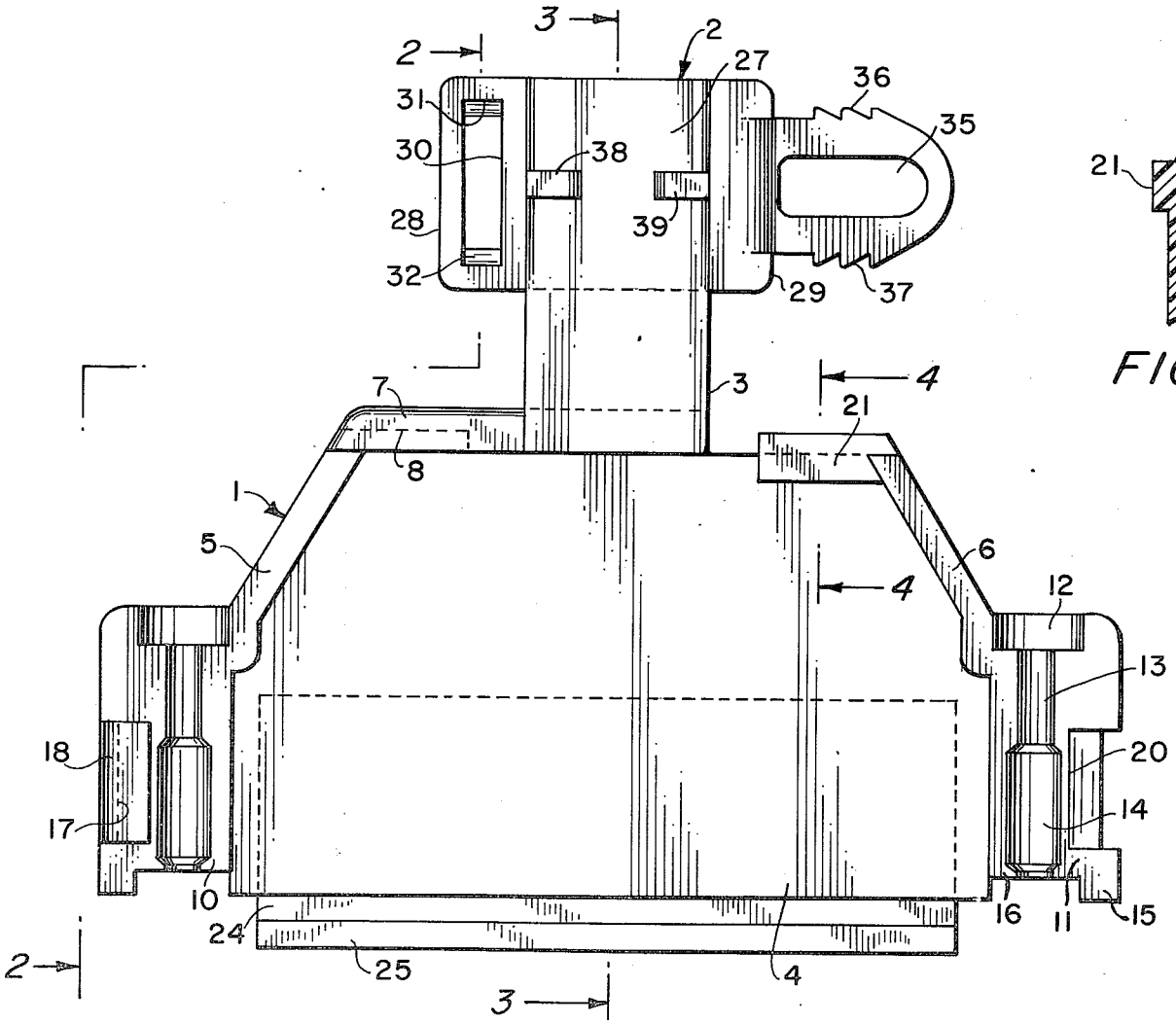
FIG. 1 is a plan view of a half-shell of a connector according to the invention.
Figure 5:
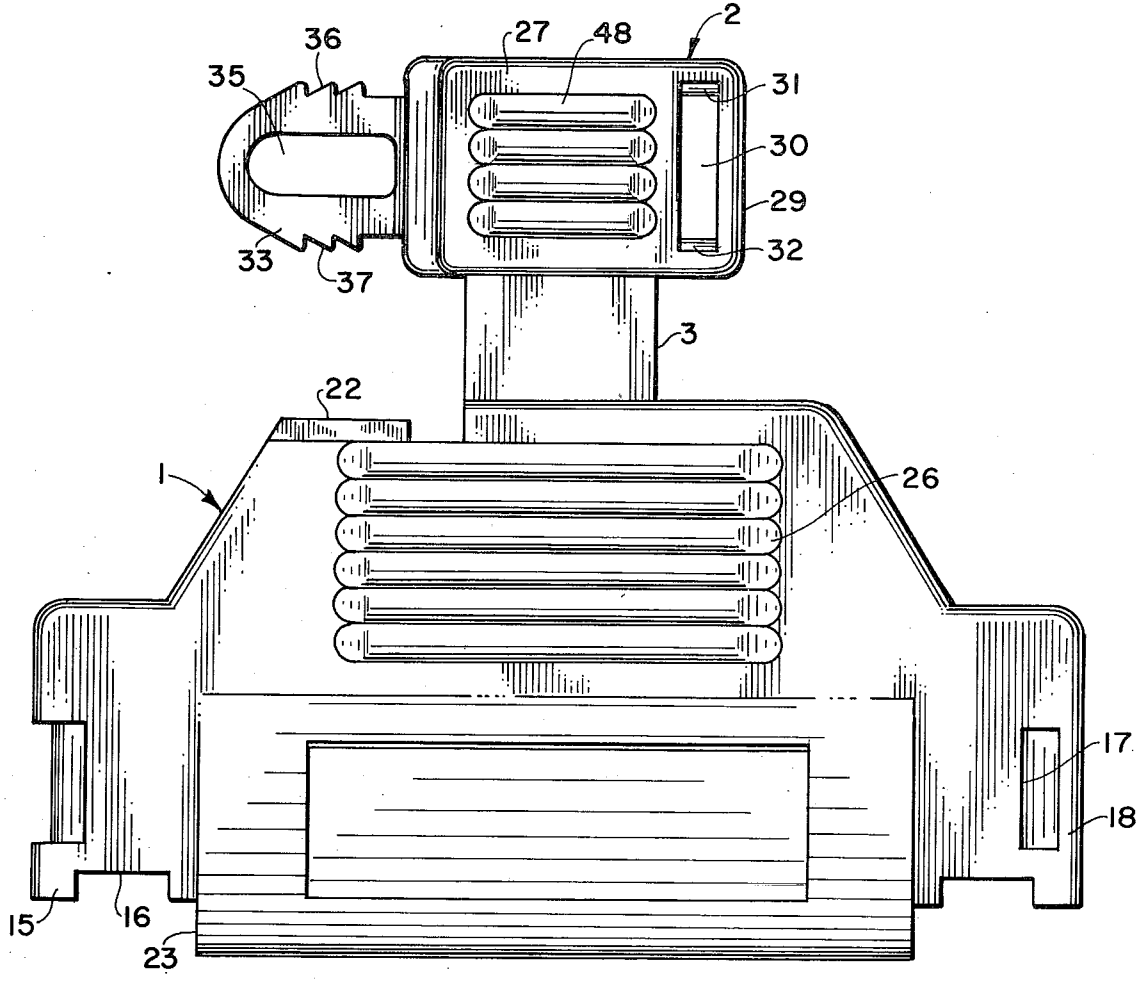
FIG. 5 is a plan view of the half-shell of FIGS. 1-3 looking from the direction opposite that of FIG. 1.
Figure 3:
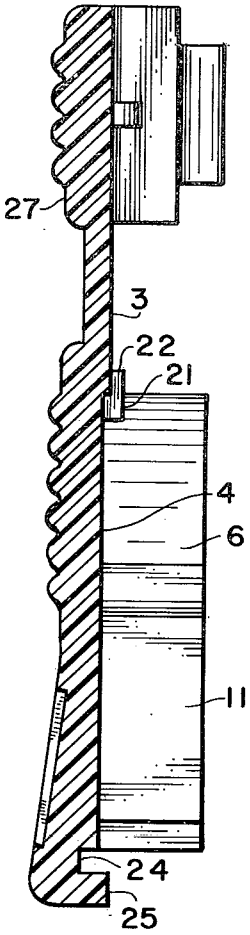
FIG. 3 is a sectional view taken along the line 3—3 of FIG. 1.

Referring to FIGS. 1 to 6, there is shown a half-shell comprising a portion 1 for insulating the metal portion of the connector and a portion 2 acting as a cable clamping means, both portions being connected to each other by means of a strip 3 integral with the portions 1 and 2.

Portion 1 comprises a large bottom wall 4 having a shape partially rectangular and partially trapezoidal, the periphery of which is defined by various walls having different height, thickness and shape. More particularly, walls 5 and 6 along the inclined sides of the trapezium have the same thickness and the same height, with the height of walls 5 and 6 substantially corresponding to one half of the height of the connector at this point when two half-shells are applied to the metal portion of the connector and connected to each other as it will be described thereafter. Wall 7 defining a section of the smaller base of the trapezium has a thickness greater than that of walls 5 and 6 and a height which is twice that of the walls 5 and 6, wall 7 being provided near its top portion, along a section of its length with a groove 8 so as to provide a hook 9 along this section. The two smaller sides of the rectangle are defined by two walls 10, 11 having the same height as the walls 5 and 6 but a thickness well smaller than that of said walls. In the top surface of each of the walls 10 and 11 a half-seat is provided for receiving a screw for fastening the connector to the apparatus in which it is inserted. These screws serve also to lock together in a known manner a pair of reference metal elements for the insertion of connector. Each of the half-seats comprises three semicircular sections having different diameters, namely a section 12 for receiving the screw head, a section 13 for receiving the unthreaded shank portion of the screw and a section 14 for receiving the threaded shank portion of the screw. The screws used are of the type having threads projecting from the unthreaded shank portion so that once the screws are inserted into the seats formed by the half-seats when two half-shells are coupled to each other, the screws can no longer be removed from the connector. Walls 10 and 11 are slightly shorter than the smaller sides of rectangle and have forwardly a projection 15 having a smaller thickness than the remainder of the wall so as to provide a recess 16 for receiving a reference metal element. In the wall 10 a slot 17 is provided and the web section 18 defining outwardly the slot extends upwardly to a height which is substantially twice that of the wall 10 and terminates with a hook-like angled section 19. In the wall 11 a recess 20 is provided having the contour shown with the dashed line in FIG. 6 and intended to receive the hook-like wall 18-19 of the mated half-shell once the connector is assembled. A section of the smaller base of trapezium which is opposite the section defined by wall 7, is provided with a projection 21 extending from the periphery of bottom wall 4 so as to form a strip 22 intended to penetrate the groove 8 of wall 7 of the other half-shell when the two half-shells are coupled. The front portion of bottom wall 4 extends in a section 23 having a length slightly shorter than that of the larger side of the rectangle, in which section a groove 24 is provided which is defined outwardly by a projection 25. On the outer surface of bottom wall 4 serrations 26 are provided in order to facilitate the grip of connector.

Portion 2 of the connector half-shell comprises a bottom wall 27 having a greater thickness than the connecting strip 3 and defined on two opposed longitudinal sides by two walls 28, 29. In the wall 28 a slot 30 is provided from which a pair of opposed teeth 31, 32 project. From wall 29 a tongue 33 projects which is connected thereto by means of a thinner section 34 (see FIG. 6) which make the connection of the tongue flexible and which has a slot 35 to impart a flexibility also to the tongue. The latter has on opposite sides two toothed portions 36, 37 intended to engage the teeth 31 and 32, respectively of slot 30. Two projections 38, 39 extending from bottom wall 27 serve to assure a good gripping of portion 2 on the cable to be clamped. Also on the outer surface of wall 27 serrations 48 are provided.

Figure 7:
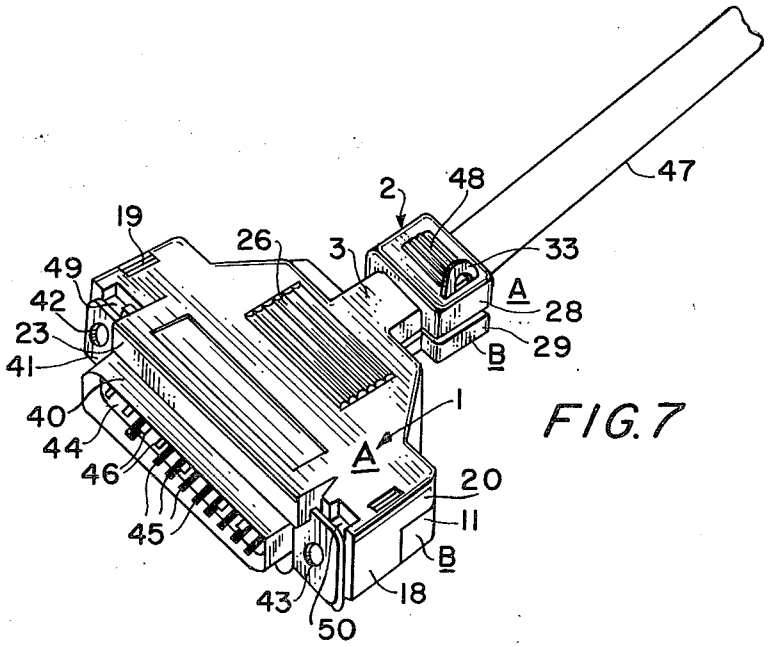
FIG. 7 is a perspective view of a complete connector according to the invention, with the supply cable connected to the contacts thereof in a smaller scale than the FIGS. 1 to 5.
Figure 6:
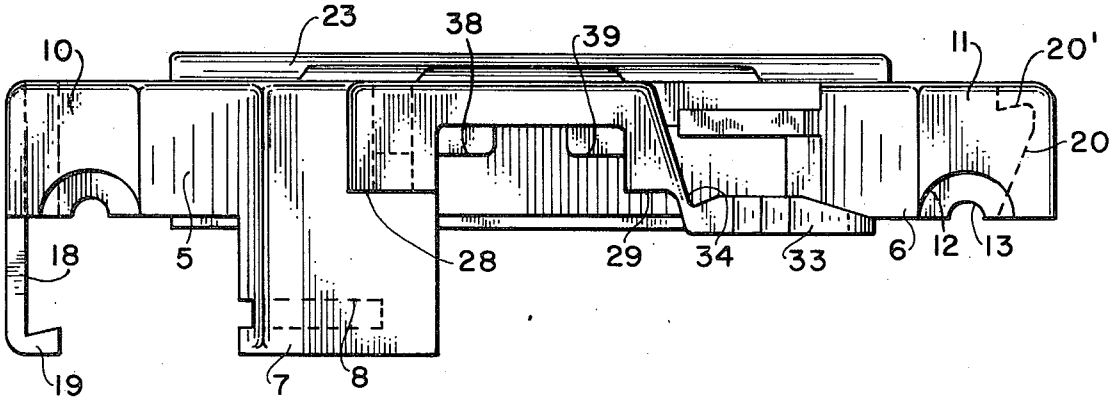
FIG. 6 is a front elevational view of the half-shell of FIGS. 1 to 4.

The assembly of two half-shells as heretofore described so as to form a connector according to the invention will be described now, in connection with FIG. 7. As can be seen from this figure, the metal portion of connector comprises an alongated housing 40 extending from a flange 41 having two holes 42, 43 for receiving two screws, not shown, intended to be housed in the seats 12, 13, 14 of the two half-shells. Inside the housing 40 there is an insulating panel 44 from which a set of pins 45 and 46 project which are arranged in two rows and constitute the electrical contacts of connector. These contacts are connected to the single conductors, not shown in FIG. 7, of a cable 47. Over the described metal portion and cable 47 two of the described half-shells, designated with A and B in FIG. 7, are applied in a position overturned with respect to each other. In coupling the two half-shells wall 18 of one half-shell penetrates the recess 20 of the other half-shell and the hook-shaped end 19 engages in the recess portion designated by 20' in FIG. 6. This coupling as all of the other couplings which will be described thereafter, occur by snap action and is made possible by the resilience of the material of which the half-shell is made, generally a plastic material. In the same step the strip 22 of one half-shell penetrates the groove 8 of portion 7 of the other half-shell. Of course, the described engagements occur mutually between A and B and vice versa. It should be understood that before coupling the two half-shells to each other in the described manner it is necessary to place the screws for connecting the connector to the apparatus and for locking the reference metal elements in the associated seats provided in one of the half-shells so that, when the half-shells are coupled together, the screws are axially restrained in their seats, without the possibility of being removed therefrom. In the assembly step where the engagement of the two half-shells occurs, the latter are locked on the metal portion of connector by the engagement of groove 24 in the front projection 23 of wall 4 of each half-shell with flange 41 of the metal housing 40, as can be seen in FIG. 7. Here the reference metal elements have been designated by 49 and 50.

In order to lock the two half-shells on the cable 37 the flexible tongue 33 of one half-shell is entered into the slot 30 of the other half-shell and the two parts 2 of both half-shells are pressed against one other until the teeth 31 and 32 of slot 30 engage a tooth of the two toothed portions 36 and 37 of tongue 33, which assures the strongest clamping of cable.

Thus, it is seen that in a single operation both the insulation for the metal portion of connector and the clamping of the supply cable of connector are achieved in an extremely simple manner.

While a single embodiment of the invention has been described and illustrated, it is obvious that various changes and modifications can be made thereto without departing from the scope of the invention.

What I claim is:

1. A two-piece insulated connector housing and strain relief means adapted to accept a metallic electrical connector having an apertured flange means substantially surrounding a cup-shaped prong contact protector and axially extending cable means, said housing including a pair of substantially identical half-shells having integral means for snap-retaining said half-shells in assembled insulated surrounding relationship to said connector and strain relief relationship to said cable, each half-shell including a base having a front rectangular portion and a rear trapezoidal portion connected with the longitudinal axis of said housing lying perpendicular to the major dimension of said portions to the rectangular portion, wall means extending normally from said base along the narrow dimensions of said rectangular portions and a substantial portion of the lateral margins of said trapezoidal portion except for a medially disposed section lying on the axis of said shell, resilient engaging means extending normally from one end of said rectangular portion, complementary shoulder means at the opposite end of said rectangular portion for accepting the resilient engaging means of the second half-shell, recess means in each wall means at opposite ends of said rectangular portion of said base adapted to accept screw means in axially restrained freely rotatable relationship for engagement with said apertured flange of said connector, strap means extending integrally from said medially disposed section of said trapezoidal portion, U-shaped strain relief means integral with said strap, second resilient engaging means disposed in one wall of said U-shaped means and second complementary shoulder means in the opposite wall of said U-shaped means for accepting the second resilient engaging means of the second half-shell, recessed groove means along a substantial portion of the unwalled free edge of said rectangular portion opposite the trapezoidal portion for accepting said flange of said connector in restrained relation, interlocking means in said wall adjacent said medially disposed section of said trapezoidal portion for locking said wall in locked encasing relation around said connector.

2. A connector according to claim 1, characterized in that the portion of each half-shell forming the connector insulation comprises a base portion defined on two opposite sides of its periphery by a pair of walls extending parallel to the longitudinal axis of connector, one of which extends for a length of its longitudinal extension in a wall having a smaller thickness and a height which is twice that of the remainder of said wall and at the end is turned at right angles so as to form a hook as said resilient engaging means, while the other of said walls is provided with said complementary engaging means as a shouldered recess having such a shape to receive the extension of the wall of an associated half-shell and to engage by snap action the end hook of said one wall.

3. A connector according to claim 1, characterized in that the portion of each half-shell forming the connector insulation comprises a bottom wall base defined on two opposite sides of its periphery by a pair of walls extending parallel to the longitudinal axis of connector and having in the top surface a half socket for a screw to secure the connector to said housing into which it is inserted and locking said flange, said socket having two semicircular portions of different diameters for receiving a screw having a threaded stem portion of different diameter with respect to the unthreaded stem portion thereof.

4. A connector according to claim 1, characterized in that the portion of each shell forming the connector insulation comprises a base defined along a portion of its periphery by a wall perpendicular to the longitudinal axis of the connector, having a height which is twice that of the other perimetral walls of the half-shells and a groove adjacent the top thereof, and said base also includes a projection substantially in line with the wall perpendicular to the connector axis and extending from the periphery of the bottom wall so as to form a strip intended, once the half-shells are coupled, to enter the groove of the wall of the other half-shell.

5. A connector according to claim 1, characterized in that said second resilient engaging means is provided with at least one serration for engagement once the half-shells are coupled with a complementary tooth shoulder projecting into a slot of the other half-shell.

6. A connector according to claim 5, characterized in that said second resilient engaging means is a shouldered stud connected to the associated wall through a flexible hinge portion.

7. A connector according to claim 6, characterized in that said stud is provided with a centrally disposed axially extending slot imparting resilience thereto.

8. A connector according to claim 7, characterised in that the bottom wall of said U-shaped means has a pair of transverse projections in line for engaging the cable.

* * * * *